US006776214B2

(12) United States Patent
Ray et al.

(10) Patent No.: US 6,776,214 B2
(45) Date of Patent: Aug. 17, 2004

(54) CENTRIFUGAL CASTING OF TITANIUM ALLOYS WITH IMPROVED SURFACE QUALITY, STRUCTURAL INTEGRITY AND MECHANICAL PROPERTIES IN ISOTROPIC GRAPHITE MOLDS UNDER VACUUM

(75) Inventors: Ranjan Ray, Phoenix, AZ (US); Donald W. Scott, Peoria, AZ (US)

(73) Assignee: Santoku America, Inc., Tolleson, AZ (US)

( * ) Notice: Subject to any disclaimer, the term of this patent is extended or adjusted under 35 U.S.C. 154(b) by 0 days.

(21) Appl. No.: 10/674,435

(22) Filed: Oct. 1, 2003

(65) Prior Publication Data

US 2004/0060685 A1 Apr. 1, 2004

Related U.S. Application Data

(63) Continuation of application No. 10/443,807, filed on May 23, 2003, which is a continuation-in-part of application No. 10/163,345, filed on Jun. 7, 2002, now Pat. No. 6,634,413.

(60) Provisional application No. 60/296,770, filed on Jun. 11, 2001, and provisional application No. 60/463,736, filed on Apr. 18, 2003.

(51) Int. Cl.[7] ..... B22D 13/00; B22C 3/00

(52) U.S. Cl. ..... 164/286; 164/289; 164/361; 164/267

(58) Field of Search ..... 164/286, 289, 164/361, 267, 529, 114, 116, 117, 72

(56) References Cited

U.S. PATENT DOCUMENTS

| | | | | |
|---|---|---|---|---|
| 2,977,222 | A | 3/1961 | Bieber | 172/823 |
| 3,241,200 | A | 3/1966 | Lirones | 164/517 |
| 3,243,733 | A | 3/1966 | Hosman | 333/106 |
| 3,256,574 | A | 6/1966 | Lirones | 164/14 |
| 3,257,692 | A | 6/1966 | Operhall | 164/517 |
| 3,265,574 | A | 8/1966 | Scolari | 600/4 |
| 3,266,106 | A | 8/1966 | Lirones | 164/517 |
| 3,296,666 | A | 1/1967 | Lirones | 164/517 |
| 3,321,005 | A | 5/1967 | Lirones | 164/518 |
| 3,389,743 | A | 6/1968 | Morozov et al. | 164/516 |
| 3,485,288 | A | 12/1969 | Zusman et al. | 164/34 |
| 3,492,197 | A | 1/1970 | Olstowski et al. | 428/412 |
| 3,519,503 | A | 7/1970 | Moore et al. | 148/514 |
| 3,547,676 | A | 12/1970 | Bokros et al. | 427/213 |
| 3,567,896 | A | 3/1971 | Chang | 219/50 |
| 3,683,996 | A | 8/1972 | Dunlop | 164/14 |
| 3,718,720 | A | 2/1973 | Lambdin, Jr. et al. | 264/29 |

(List continued on next page.)

FOREIGN PATENT DOCUMENTS

| | | |
|---|---|---|
| JP | 55149747 | 11/1980 |
| JP | 60040644 | 3/1985 |
| SU | 1306641 | 4/1987 |

OTHER PUBLICATIONS

USSN 10/143,920, Ranjan Ray et al., filed May 14, 2002.
USSN 10/151,871, Ranjan Ray et al., filed May 22, 2002.
USSN 60/463,736, Ranjan Ray et al., filed Apr. 18, 2003.

*Primary Examiner*—Kiky Stoner
*Assistant Examiner*—I.-H. Lin
(74) *Attorney, Agent, or Firm*—Stevens, Davis, Miller & Mosher, LLP

(57) ABSTRACT

Methods for making various titanium base alloys and titanium aluminides into engineering components such as rings, tubes and pipes by melting of the alloys in a vacuum or under a low partial pressure of inert gas and subsequent centrifugal casting of the melt in the graphite molds rotating along its own axis under vacuum or low partial pressure of inert gas are provided, the molds having been fabricated by machining high density, high strength ultrafine grained isotropic graphite, wherein the graphite has been made by isostatic pressing or vibrational molding, the said molds either revolving around its own horizontal or vertical axis or centrifuging around a vertical axis of rotation.

7 Claims, 12 Drawing Sheets

U.S. PATENT DOCUMENTS 3,781,158 A 12/1973 Leghorn ..... 164/459
3,802,902 A * 4/1974 Turner et al. ..... 106/38.3
3,900,540 A 8/1975 Robba et al. ..... 264/29.6
4,005,163 A 1/1977 Bokros ..... 264/81
4,129,462 A 12/1978 Korenko ..... 148/31
4,209,348 A 6/1980 Duhl et al. ..... 148/555
4,226,900 A 10/1980 Carlson et al. ..... 427/228
4,453,985 A 6/1984 Gessinger et al. ..... 148/501
4,574,015 A 3/1986 Genereux et al. ..... 148/677
4,579,602 A 4/1986 Paulonis et al. ..... 148/677
4,608,192 A 8/1986 Su ..... 252/506
4,612,062 A 9/1986 Nazmy et al. ..... 148/501
4,627,945 A 12/1986 Winkelbauer et al. ..... 264/29.5
4,670,201 A 6/1987 Montgomery et al. ..... 264/26
4,719,080 A 1/1988 Duhl et al. ..... 420/443
4,761,272 A 8/1988 Hucke ..... 423/445
4,769,087 A 9/1988 Genereux et al. ..... 148/677
5,026,521 A 6/1991 Kajimura et al. ..... 420/422
5,163,498 A 11/1992 Kantner et al. ..... 164/97
5,176,762 A 1/1993 Berczik ..... 148/407
5,226,946 A 7/1993 Diehm et al. ..... 75/10.14
5,489,411 A 2/1996 Jha et al. ..... 419/3
5,525,276 A 6/1996 Okuyama et al. ..... 264/29.3
5,630,465 A * 5/1997 Feagin ..... 164/361
5,665,262 A 9/1997 Hajaligol et al. ..... 219/553
5,705,139 A 1/1998 Stiller et al. ..... 423/445 R
5,924,470 A 7/1999 Costilla-Vela et al. ..... 164/4.1
5,964,091 A 10/1999 Fukui et al. ..... 60/752
6,250,366 B1 * 6/2001 Choudhury et al. ..... 164/118
6,408,929 B2 * 6/2002 Choudhury et al. ..... 164/338.1
6,634,413 B2 * 10/2003 Ray et al. ..... 164/114

* cited by examiner

CENTRIFUGAL CASTING OF TITANIUM ALLOYS WITH IMPROVED SURFACE QUALITY, STRUCTURAL INTEGRITY AND MECHANICAL PROPERTIES IN ISOTROPIC GRAPHITE MOLDS UNDER VACUUM

RELATED APPLICATION INFORMATION

This is a continuation of U.S. patent application Ser. No. 10/443,807, filed May 23, 2003 which is a continuation-in-part of U.S. patent application Ser. No. 10/163,345 filed Jun. 7, 2002, and now issued as U.S. Pat. No. 6,634,413, which claims priority from U.S. Provisional Patent Application serial No. 60/296,770 filed on Jun. 11, 2001; this also claims priority from U.S. Provisional Patent Application serial No. 60/463,736 filed Apr. 18, 2003 and having the same title as the present application, all of these patent applications are incorporated herein by reference in their entirety.

I. FIELD OF THE INVENTION

The invention relates to methods for making metallic alloys such as titanium base alloys into castings of various symmetric and asymmetric shapes, cylinders, hollow tubes, pipes, rings and other tubular products by melting the alloys in a vacuum or under a low partial pressure of inert gas and subsequently centrifugally casting the melt under vacuum or under a low pressure of inert gas in molds machined from fine grained high density, high strength isotropic graphite, the said molds either revolving around its own horizontal or vertical axis or centrifuging around a vertical axis of rotation.

II. BACKGROUND OF THE INVENTION

The combination of high strength-to-weight ratio, excellent mechanical properties, and corrosion resistance makes titanium the best material for many applications. Titanium alloys are used for static and rotating gas turbine engine components. Some of the most critical and highly stressed civilian and military airframe parts are made of these alloys. The use of titanium has expanded in recent years from applications in aerospace structure to food processing plants and from oil refinery heat exchangers to marine components and medical prostheses. However, the high cost of fabricating titanium alloy components may limit their widespread use.

Some materials which have been found to give excellent results in certain areas of application are listed below by way of example: Pure Ti, Ti—6Al—4V, Ti—6Al—2Sn—4Zr—2Mo, Ti—5Al—2.5Fe, Ti—15V—3Al—3Cr—3Sn, Ti—46Al—2Cr—2Nb, Ti—50Al.

Another family of titanium alloys based on the intermetallic Ti—50Al compositions are being considered for various applications because of their low density, relatively high strength at high temperatures, and corrosion resistance.

While complex shapes of titanium alloys are fabricated by the casting route, somewhat simpler shapes such as seamless rings, hollow tubes and pipes are manufactured by various other thermo-mechanical processing routes. The relatively high cost of titanium components is often fabricating costs, and, usually most importantly, the metal removal costs incurred in obtaining the desired end-shape. As titanium has become a commonly used engineering material there has been a need to produce complex shapes economically. As a result, in recent years a substantial effort has been focused on the development of net shape or near-net shape technologies such as powder metallurgy (PM), superplastic forming (SPF), precision forging, and precision casting. Precision casting is by far the most fully developed and the most widely used net shape technology.

High performance titanium castings are used in large numbers in the aerospace industry while the chemical and energy industries primarily use large castings where corrosion resistance is a major consideration in design and material choice. The microstructure of as-cast titanium is desirable for many mechanical properties such as creep resistance, fatigue crack growth resistance, fracture resistance and tensile strength. Titanium castings are essentially equal in strength, fracture toughness and fatigue crack growth resistance to the corresponding wrought products.

Many titanium castings with precision and complex geometries are made by the well known investment casting process wherein an appropriate melt is cast into a preheated ceramic investment mold formed by the lost wax process, the castings are generally made in static molds. Although defects such as inclusions, gas porosity, hot tears, shrink cavities and mold/metal reactions are common to all foundry products, dealing with these problems require a different approach when casting titanium. The inability to superheat titanium melt in a cold crucible coupled with narrow liquidus/solidus temperature of molten titanium often requires the need of the centrifugal casting technique for making high quality thin walled configurations. A typical centrifugal investment casting machine spins radially symmetric molds about its own axis in a vertical orientation. Simultaneous rotation of a tree of molds located along the perimeter of a circle on a horizontal plane where melt is poured into a central sprue lying along the vertical axis of the tree creates high velocity flow of titanium melt under the action of centrifugal force. By rotation of the tree the melt flows into the mold cavities, keeping contact with one of the vertical inside walls of a gate and a mold cavity. Centrifugal force allows the melt to flow into even the most obscure crevices of the mold cavities The action of centrifugal force leads to improved mold filling and production of high quality precision castings of titanium alloys. The centrifugal force imposed on the melt enhances removal of gas bubbles and reduces the number of gaseous defects to a minimum and improves the mechanical properties.

U.S. Pat. No. 6,250,366, U.S. Pat. No. 6,408,929 and U.S. Pat. No. 6,443,212 disclose a technique and apparatus suitable of production of titanium castings via centrifugal casting in which the molds are arranged about a central axis of rotation like the spoke of a wheel, thus permitting multiple castings is also used to produce sound titanium castings. However, there are certain drawbacks associated with centrifugal casting of titanium in ceramic investment molds. During high velocity flow of melt through the mold cavities under the action of centrifugal force, ceramic walls/linings of the molds in contact with the highly reactive titanium base alloy melts are likely to cause cracking and spalling leading to formation of very rough, outside surface of the casting. The ceramic liners spalling off the mold are likely to get trapped inside the solidified titanium castings as detrimental inclusions which will significantly lower fracture toughness properties of the finished products.

Titanium alloys are fabricated in shapes such as seamless ring configurations, hollow tubes and pipes and find many engineering applications in jet engines such as compressor casings, seal and other high performance components for oil and chemical industries. FIG. 1 shows a diagram of a turbine casing 10 and a compressor casing 20. The compressor casing is made of titanium alloys. FIG. 2 shows a cutway diagram of a turbofan engine and the compressor casing 30 made of titanium alloy. Seamless rings can be flat (like a washer), or they can feature higher vertical walls (approximating a hollow cylindrical section). Heights of rolled rings range from less than an inch up to more than 9 ft. Depending on the equipment utilized, wall-thickness/height ratios of rings typically range from 1:16 up to 16:1, although greater proportions have been achieved with special processing.

There are two primary processes for fabricating seamless rings of titanium alloys. In the ring forging process also called saddle-mandrel forging, an upset and punched ring blank is positioned over a mandrel, supported at its ends by saddles on a forging press. As the ring is rotated between each stroke, the press ram or upper die deforms the metal ring against the expanding mandrel, reducing the wall thickness and increasing the ring diameter.

In continuous ring rolling, seamless rings are produced by reducing the thickness of a pierced blank between a driven roll and an idling roll in specially designed equipment. Additional rolls (radial and axial) control the height and impart special contours to the cross-section. Ring rollers are well suited for, but not limited to, production of larger quantities, as well as contoured rings. In practice, ring rollers produce seamless rolled rings to closer tolerances or closer to finish dimensions. FIGS. 3A–3G schematically show the various steps of seamless rolled ring forging process operations. FIG. 4 shows a ring rolling machine in operation.

FIGS. 3A–3G show an embodiment of a seamless rolled ring forging process operation to make a ring 40. FIG. 3A shows the ring rolling process typically begins with upsetting of the starting stock 42 on flat dies 44 at its plastic deformation temperature—in the case of grade 1020 steel, approximately 2200 degrees Fahrenheit, to make a relatively flatter stock 43. FIG. 3B shows that piercing the relatively flatter stock 43 involves forcing a punch 45 into the hot upset stock causing metal to be displaced radially, as shown by the illustration. FIG. 3C shows a subsequent operation, namely shearing with a shear punch 46, serves to remove a small punch out 43A to produce an annular stock 47. FIG. 3D shows removing the small punch out 43A produces a completed hole through the annular stock 47, which is now ready for the ring rolling operation itself. At this point the annular stock 47 is called a preform 47. FIG. 3E shows the doughnut-shaped preform 47 is slipped over the ID (inner diameter) roll 48 shown from an "above" view. FIG. 3F shows a side view of the ring mill and preform 47 workpiece, which squeezes it against the OD (outer diameter) roll 49 that imparts rotary action. FIG. 3G shows this rotary action results in a thinning of the section and corresponding increase in the diameter of the ring 40. Once off the ring mill, the ring 40 is then ready for secondary operations such as close tolerance sizing, parting, heat treatment and test/inspection.

FIG. 4 shows a photograph of a ring 40 roll forging in operation.

Rings featuring complex, functional cross-sections are produced by machining or forging of simple rings. Aptly named, these "contoured" rolled rings can be produced in many different shapes with contours on the inside and/or outside diameters.

Production of titanium alloy rings from forging billets requires multiple steps by ring rolling. These alloys are difficult to hot work and can be hot deformed with small percentage of deformation in each step of ring roll forging. After each deformation operation, the outside and inside diameters of the stretched ring need to be ground to remove oxidized layers and forging cracks before reheating the ring for the next cycle of hot forging. Because of the extensive fabrication steps involved, the production costs are very high and yields are low. Typically, a 60 inch diameter ring weighing 250 lbs. suitable for application as a large jet engine casing is produced by ring roll forging of a starting billet weighing 2000 lbs. The high loss of expensive materials during fabrication steps results in high cost of the finished products.

A viable alternative to the conventional ring rolling process for fabricating seamless rings, contoured rings and other tubular shapes is horizontal centrifugal casting also known as true centrifugal casting which spins the mold around its own axis. Castings produced by this technique will always have a true cylindrical bore or inside diameter regardless of shape or configuration. Castings produced by this method undergo directional cooling or solidification from the outside of the casting towards the axis of rotation. The mechanical properties of centrifugally cast tubes are often equivalent to conventionally cast and hot-worked material. The uniformity and density of centrifugal castings approaches that of wrought material, with the added advantage that the mechanical properties are nearly equal in all directions. Many engineering ferrous and non-ferrous alloys which are amenable to processing by air melting and casting can be conveniently processed in tubes by centrifugal casting in air. However, reactive titanium alloys require melting and casting in vacuum. Furthermore, during high speed rotation of the centrifugal mold lined with high purity ceramics, the highly reactive titanium base alloy melts are likely to cause cracking and spalling of the ceramic liner leading to formation of very rough, outside surface of the cast tube. The ceramic liners spalling off the mold are likely to get trapped inside the solidified superalloy tube as detrimental inclusions which will significantly lower fracture toughness properties of the finished products.

Casting of titanium and titanium alloys requires special melting, mold-making practices, and equipment to prevent alloy contamination. Because of highly reactive characteristics of titanium with ceramic materials, expensive mold materials (yttria, thoria and zirconia) are used to make investment molds for titanium castings. At elevated temperatures, titanium and its alloys react with the mold facecoat that typically comprises a ceramic oxide to form a brittle, oxygen-enriched surface layer, known as alpha case, which adversely affects mechanical properties of the casting. Alpha case produced in commercial titanium casting processes may range from about 0.005 inches to 0.04 inches in thickness depending on process and casting size. It is removed by a post-casting chemical milling operation as described, for example, in Lassow et al. U.S. Pat. No. 4,703,806. Strict EPA regulations have to be followed to pursue chemical milling. Moreover, ceramic oxide particles originating from the mold facecoat can become incorporated in the casting below the alpha case layer as sub-surface inclusions by virtue of interaction between the reactive melt and the mold facecoat as well as mechanical spallation of the mold facecoat during the casting operation. The sub-surface oxide inclusions are not visible upon visual inspection of the casting, even after chemical milling. However, any sub-surface ceramic inclusions located below the alpha case in the casting are not removed by the chemical milling operation and can lead to degradation of mechanical properties. The extra cost imposed by the chemical milling operation is a disadvantage and presents a serious problem from the standpoint of accuracy of dimensions. Normally, the tooling must take into consideration the chemical milling which results in the removal of some of the material to produce a casting that is dimensionally correct. However, because casting conditions vary, the alpha case will vary along the surface of the casting. This means there is a considerable problem with regard to dimensional variation.

Feagin, U.S. Pat. No. 5,630,465 discloses ceramic shell molds made from yttria slurries, for casting reactive metals. Richerson, U.S. Pat. No. 4,040,845 shows a ceramic composition for crucibles and molds containing a major amount of yttrium oxide and a minor amount of a heavy rare earth mixed oxide. Such methods including the making of a titanium metal enriched yttrium oxide were only partially successful because of the elaborate and expensive technique which required repetitive steps. Schneider, U.S. Pat. No. 3,815,658 shows molds which are less reactive to steels and steel alloys containing high chromium, titanium and aluminum contents in which a magnesium oxide-forsterite composition is used as the mold surface.

Operhall, U.S. Pat. No. 2,806,271 shows coating a pattern material with a continuous layer of the metal to be cast, backed up with a high heat conductivity metal layer and investing in mold material. Basche, U.S. Pat. No. 4,135,030 shows impregnation of a standard ceramic shell mold with a tungsten compound and firing in a reducing atmosphere such as hydrogen to convert the tungsten compound to metallic tungsten or tungsten oxides. These molds are said to be less reactive to molten titanium but they still have the oxide problems associated with them.

Brown, U.S. Pat. No. 4,057,433 discloses the use of fluorides and oxyfluorides of the metals of Group IIIa and the lanthanide and actinide series of Group IIIb of the Periodic Chart as constituents of the mold surface to minimize reaction with molten titanium. This reference also shows incorporation of metal particles of one or more refractory metal powders as a heat sink material. However, even those procedures have resulted in some alpha case problems. Feagin, U.S. Pat. No. 4,415,673 discloses a zirconia binder which is an aqueous acidic zirconia sol used as a binder for an active refractory including stabilized zirconia oxide thereby causing reaction and gelation of the sols. Solid molds were made for casting depleted uranium. A distinction is made in this patent between "active" refractories and refractories which are relatively inert. The compositions of Feagin are intended to contain at least a portion of active refractories. See also Feagin, U.S. Pat. No. 4,504,591.

Some refractory compositions have been developed that exhibit reduced alpha case and can be used successfully to make production castings by applying the coatings to the wax patterns by special techniques, such as spraying. However, a difficulty arises in that certain refractory mixes do not have a long pot life and gel quickly, even spontaneously with stirring in a few minutes, depending upon exact composition. See Holcombe et al., U.S. Pat. No. 4,087,573.

The use of graphite in investment molds has been described in the art in such patents as U.S. Pat. Nos. 3,241,200; 3,243,733;3,266,106;3,296,666 and 3,321,005 all to Lirones. Other prior art which show a carbonaceous mold surface utilizing graphite powders and finely divided inorganic powders called "stuccos" are Operhall, U.S. Pat. No. 3,257,692; Zusman et al., U.S. Pat. No. 3,485,288 and Morozov et al., U.S. Pat. No. 3,389,743. These documents describe various ways of obtaining a carbonaceous mold surface by incorporating graphite powders and stuccos, various organic and inorganic binder systems such as colloidal silica, colloidal graphite, synthetic resin which are intended to reduce to carbon during burnout, and carbon coated refractory mold surfaces. These systems were observed to have the disadvantage of the necessity for eliminating oxygen during burnout, a limitation on the mold temperature and a titanium carbon reaction zone formed on the casting surface.

Further developments including variations in foundry molds are shown in Turner et al., U.S. Pat. No. 3,802,902 which uses sodium silicate bonded graphite and/or olivine which was then coated with a relatively non-reactive coating such as alumina. However, this system still did not produce a casting surface free of contamination.

Rammed graphite is used to produce molds for casting of reactive metals and alloys based on titanium. Such molds are made from a mixture of finely divided graphite having a closely controlled particle size and size distribution. Water, pitch, baume syrup and starch are added to coat the graphite powders and provide optimal mold properties.

A number of attempts have been made in the past to coat the graphite and the ceramic molds with materials which would not react with the reactive metals being cast. For example, metallic powders such as tantalum, molybdenum, columbium, tungsten, and also thorium oxide had been used as non-reactive mold surfaces with some type of oxide bond. See Brown, U.S. Pat. Nos. 3,422,880; 3,537,949 and 3,994,346.

Adhesive plasters made of a suspension of oxide powder, such as yttrium oxide and an acid are shown in Holcombe et al., U.S. Pat. No. 4,087,5.73. These compositions are described as being spontaneously hardening and useful for coating surfaces or for casting into a shape. Of particular interest is the coating of graphite crucible used in uranium melting operations.

Permanent mold casting has been employed in the past as a relative low cost casting technique to mass produce aluminum, copper, and iron based castings having complex, near net shape configurations. However, only fairly recently have attempts been made to produce titanium and titanium alloy castings using the permanent mold casting process. For example, the Mae et al U.S. Pat. No. 5,119,865 issued Jun. 9, 1992, discloses a copper alloy mold assembly for use in the permanent mold, centrifugal casting of titanium and titanium alloys. Mae, et al discloses mold body is made of one alloy selected from a group consisting of a Cu—Zr alloy, a Cu—Cr—Zr alloy, a Cu-Be alloy, a Cu—Cr alloy and a Cu—Ag alloy.

Colvin et al U.S. Pat. Nos. 5,287,994 and 5,443,111 discloses metallic permanent mold made of low carbon steel or titanium for fabrication of titanium and nickel based castings. A suitable melt having a relatively low melt superheat is poured into a mold cavity defined by one or more mold members where the melt solidifies to form the desired casting. The melt super-heat is limited so as not to exceed about 150 degree. F above the liquidus temperature of the particular melt being cast. The mold body-to-mold cavity volume ratio is controlled between 10:1 to 0.5:1 to minimize casting surface defects and mold wear/damage. The '111 patent discloses the use of a differential pressure is on the melt to be cast so as to assist filling of the mold cavity with the melt. The differential pressure can be established by evacuating the mold cavity relative to the ambient atmosphere while the melt is introduced into the mold. Alternately or in addition, the ambient atmosphere can be pressurized while the melt is introduced into the mold to provide such differential pressure. In still another embodiment of the '111 patent, the solidified casting is removed (e.g. ejected) while hot to avoid damage to the casting that could occur as a result of mold constraints associated with a particular complex casting configuration.

Choudhury et al U.S. Pat. Nos. 5,626,179, 5,950,706 discloses a reusable casting mold having a surface which comes in contact with molten metal, the said surface consisting of at least one metal selected from the group consisting of tantalum, tantalum alloys, niobium, niobium alloys, zirconium, and zirconium alloys, and casting in said mold a melt of a reactive metal selected from the group consisting of titanium and titanium alloys.

There is a need for an improved cost effective process for making castings of titanium alloys of various symmetric and asymmetric shapes with thin walls, cylinders, pipe, tubular products and seamless rings with simple or contoured cross sections which can be inexpensively machined into final shapes suitable for jet engine and other high performance engineering applications.

III. PREFERRED OBJECTS OF THE PRESENT INVENTION

It is an object of the invention to centrifugally cast titanium and titanium based alloys into various complex symmetric and asymmetric shapes as well as tubes, pipes and rings under vacuum or partial pressure of inert gas in reusable isotropic graphite molds, the molds either revolving around its own horizontal or vertical axis or centrifuging around a vertical axis of rotation.

It is another object of the present invention to provide a centrifugal casting apparatus that includes an isotropic graphite mold.

It is another object of the invention to centrifugally cast titanium base alloys in isotropic graphite molds with the mold cavity coated with a thin layer of dense, hard and wear resistant refractory metal carbide and boride coating such hafnium carbide, titanium carbide, hafnium diboride or titanium diboride.

It is another object of the invention to centrifugally cast titanium base alloys in isotropic graphite molds with the mold cavity coated with a thin layer of dense and wear resistant refractory metal coating such tungsten and/or rhenium.

IV. SUMMARY OF THE INVENTION

This invention relates to a process for making various metallic alloys such as titanium based alloys as engineering components by vacuum induction or vacuum arc melting of the alloys and subsequent centrifugal casting of the melt under vacuum in isotropic graphite molds, the molds rotating around its own horizontal or vertical axis or centrifuging around a vertical axis of rotation. More particularly, this invention relates to the use of high density high strength isotropic graphite.

With true centrifugal casting, an isotropic graphite metal mold revolves under vacuum at high speeds in a horizontal, vertical or inclined position as the molten metal is being poured. The axis of rotation may be horizontal or inclined at any angle up to the vertical position. Molten metal is poured into the spinning mold cavity and the metal is held against the wall of the mold by centrifugal force. The speed of rotation and metal pouring rate vary with the alloy and size and shape being cast.

As molten alloy is poured into a rotating isotropic graphite mold, it is accelerated to mold speed. Centrifugal force causes the metal to spread over and cover the mold surface. Continued pouring of the molten metal increases the thickness to the intended cast dimensions. Rotational speeds vary but sometimes reach more than 150 times the force of gravity on the outside surface of the castings. Once the metal is distributed over the mold surface, solidification begins immediately. Metal feeds the solid-liquid interface as it progresses toward the bore. This, combined with the centrifugal pressure being applied, results in a sound, dense structure across the wall with impurities generally being confined near the inside surface. The inside layer of the solidified part can be removed by boring if an internal machined surface is required.

For specialized engineered shapes, centrifugal casting offers the following distinct benefits of titanium based alloys:

(1) Any titanium common to static pouring under vacuum can be centrifugally cast in accordance with the present invention as a tubular product, ring and pipe.

(2) Mechanical properties of centrifugally cast titanium according to the present invention will be excellent.

Centrifugal castings of titanium base alloys can be made in almost any required length, thickness and diameter. Because the mold forms only the outside surface and length, castings of many different wall thicknesses can be produced from the same size mold. The centrifugal force of this process keeps the casting hollow, eliminating the need for cores.

Horizontal centrifugal casting technique is suitable for the production of titanium alloys pipe and tubing of long lengths. The length and outside diameter are fixed by the mold cavity dimensions while the inside diameter is determined by the amount of molten metal poured into the mold.

Castings other than cylinders and tubes also can be produced in vertical casting machines. Castings such as controllable pitch propeller hubs, for example, can be made using this variation of the centrifugal casting process.

The outside surface of the casting or the mold surface proper can be modified from the true circular shape by the introduction of flanges or small bosses, but they must be generally symmetrical about the axis to maintain balance. The inside surface of a true centrifugal casting is always cylindrical. In semi-centrifugal casting, a central core is used to allow for shapes other than a true cylinder to be produced on the inside surface of the casting.

The uniformity and density of centrifugal castings approaches that of wrought material, with the added advantage that the mechanical properties are nearly equal in all directions. Most alloys can be cast successfully by the centrifugal process, once the fundamentals have been mastered. Since no gates and risers are used, the yield or ratio of casting weight-to-weight of metal is high. High tangential strength and ductility will make centrifugally cast titanium alloys well-suited for torque- and pressure-resistant components, such as gears, engine bearings for aircraft, wheel bearings, couplings, rotor spacers, sealed discs and cases, flanges, pressure vessels and valve bodies. Titanium alloy melts do not react with high density, ultra fine grained isotropic graphite molds and hence, the molds can be used repeatedly many times thereby reducing significantly the cost of fabrication of centrifugally cast titanium alloy components compared to traditional processes. Near net shape parts can be cast, eliminating subsequent operating steps such as machining.

A motor may be employed for spinning the centrifugal casting apparatus according to the present invention. In one embodiment, the mold may be two longitudinally split pieces. In another embodiment, the mold may be two transversely split pieces.

In the centrifuge casting of titanium in isotropic graphite molds, the molds may be located on the circumference of a horizontal circle. Mold cavities are connected via radial runner-gate assembly to a central downsprue located along the vertical axis at the center of the circle.

Simultaneous rotation of a tree of molds located along the perimeter of circle on a horizontal plane while melt is being poured into a central downsprue lying along the vertical axis of the tree creates high velocity flow of melt under the action of centrifugal force. Melt is forced through the runner into the mold cavities filling thin sections with attendant fine detail and form. The centrifugal force allows the melt to flow into even the most obscure crevices of the mold cavities. Centrifugation is maintained until the melt solidifies.

The centrifugal force imposed on the melt enhances removal of gas bubbles and reduces the number of gaseous defects to a minimum and improves the mechanical properties of the castings. An additional advantage of centrifugation is a more efficient use of metal due to the parabolic free surface of the liquid metal in the mold. The metal charge weight can be carefully adjusted for each mold configuration to ensure the filling of each casting cavity and its 'runner ', while leaving a significant portion of the central down sprue devoid of metal.

The titanium castings that can be produced in accordance with the scope of the present invention will find many diverse applications, for example aero engine components and airframe structural parts, missile guidance components requiring a coefficient of expansion very similar to glass, high strength cryogenic parts for space exploration, and fatigue resistant and tissue compatible surgical implants.

In accordance with the present invention based on centrifugal casting of titanium alloys, the durability of the high density high strength isotropic graphite molds can be further enhanced by having the mold cavity coated with a hard wear resistant coating of refractory metal carbide such as hafnium carbide or refractory metals such as tungsten or rhenium. Such coatings with desirable properties and thickness between 2 to 200 microns and preferably 10–25 microns can be produced on the machined cavity of the isotropic graphite mold via one of the processes such as the chemical vapor deposition (CVD), sputtering, magnetron-sputtering or plasma assisted chemical vapor deposition techniques.

The present invention has a number of advantages:

(1) Use of ultrafine grained isotropic graphite molds to fabricate titanium castings improves quality and achieves superior mechanical properties compared to castings made by a conventional investment casting process.

(2) The molds can be used repeatedly many times thereby reducing significantly the cost of fabrication of castings compared to traditional process.

(3) Near net shape parts can be cast, eliminating subsequent operating steps such as machining.

(4) The castings can be made in molds held at room or low temperatures resulting in finer grain structures and improved mechanical properties.

V. BRIEF DESCRIPTION OF THE DRAWINGS

VI. DETAILED DESCRIPTION OF THE PREFERRED EMBODIMENTS

A. Graphite

Figure 1:
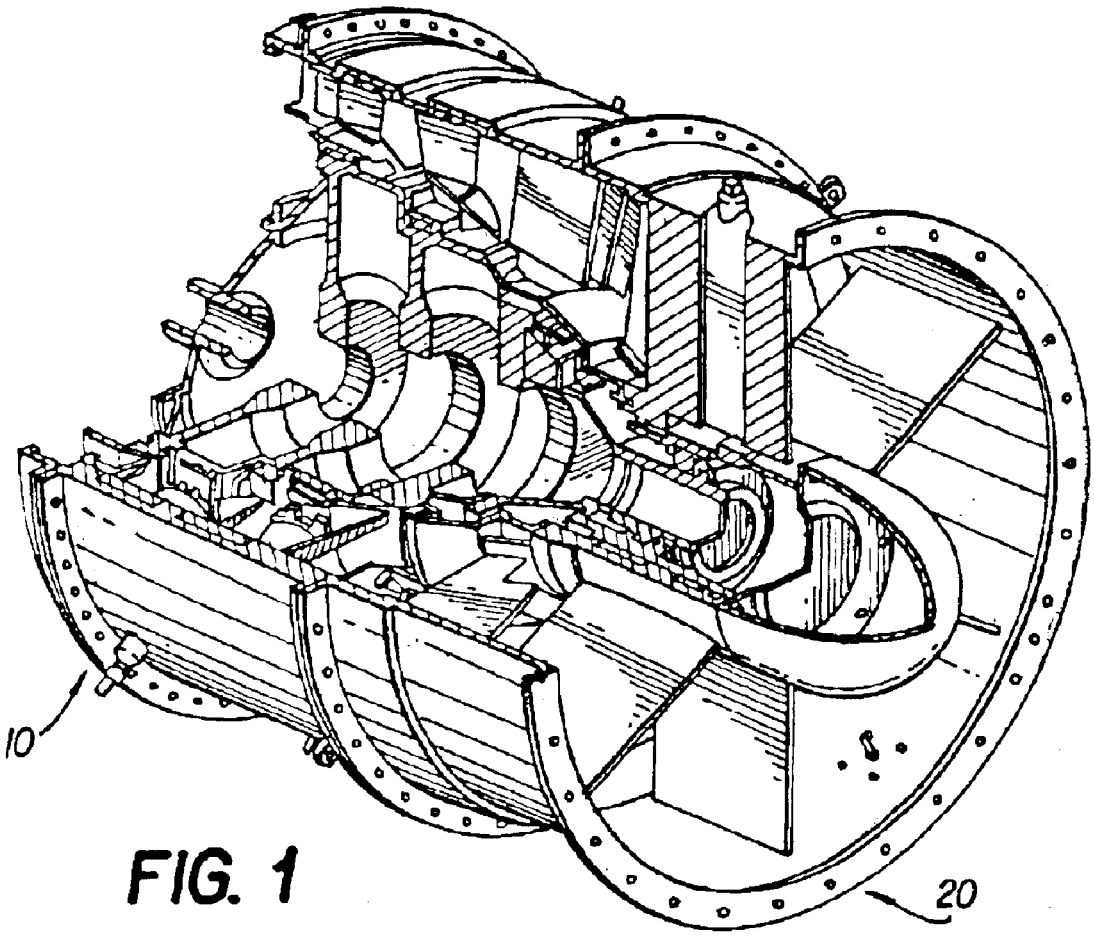
FIG. 1 shows a turbine casing and compressor casing.
Figure 2:
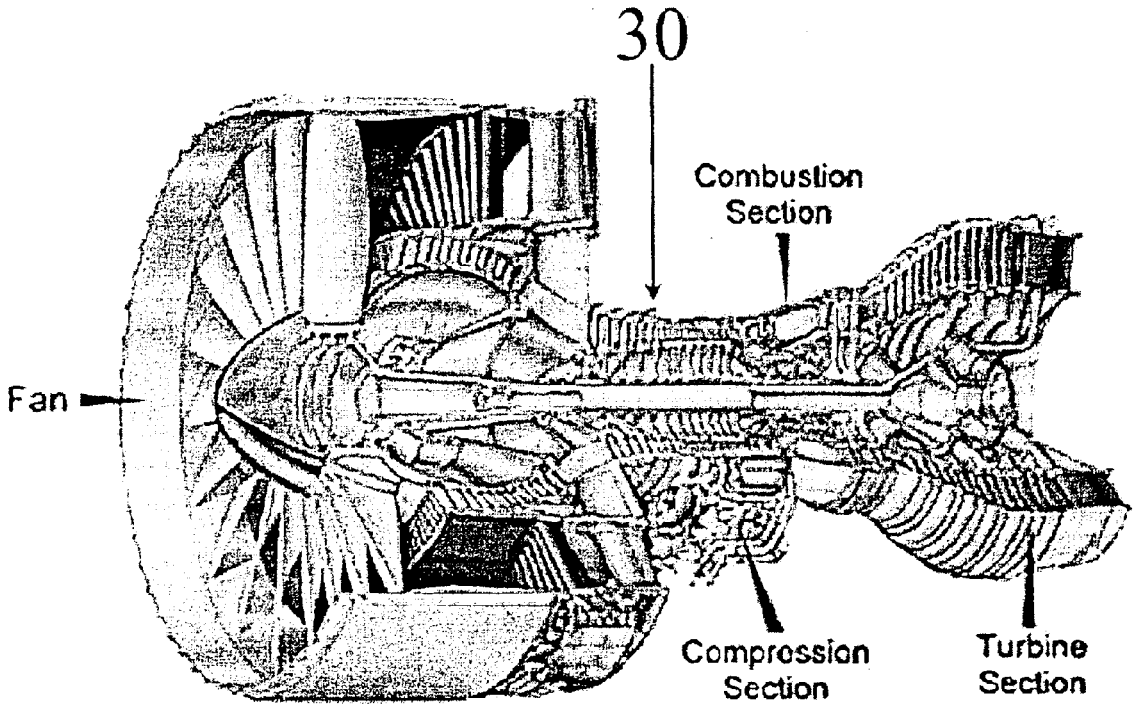
FIG. 2 shows a cut away view of a compressor.
Figure 3A:
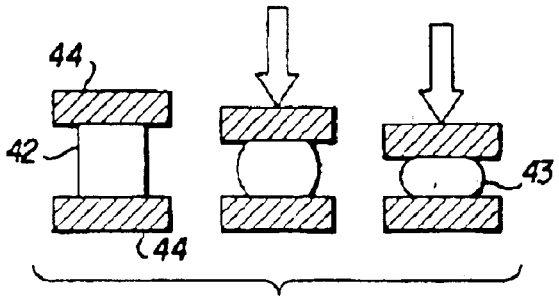
FIGS. 3A–3G show an embodiment of a seamless rolled ring forging process operation.
Figure 3B:
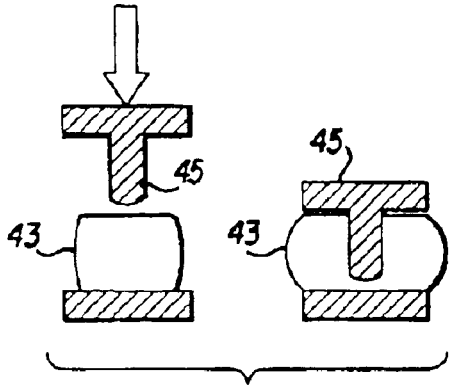
Figure 3C:
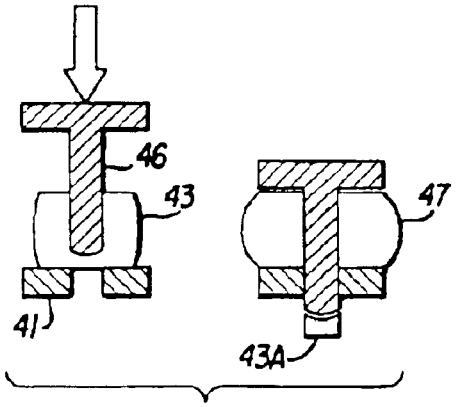
Figure 3D:
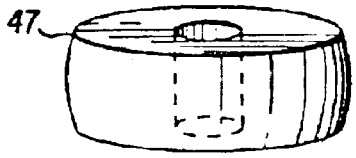
Figure 3E:
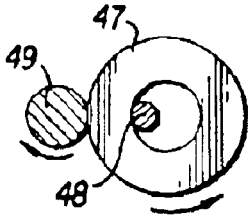
Figure 3F:
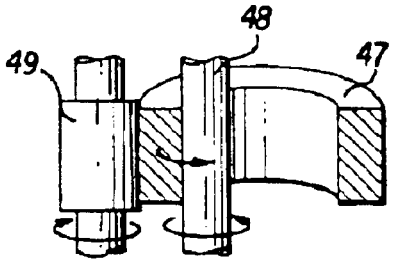
Figure 3G:
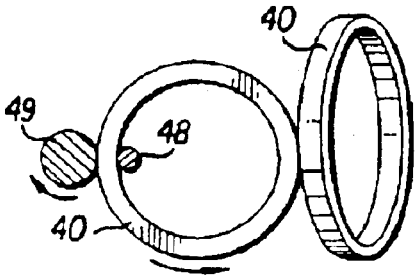
Figure 4:
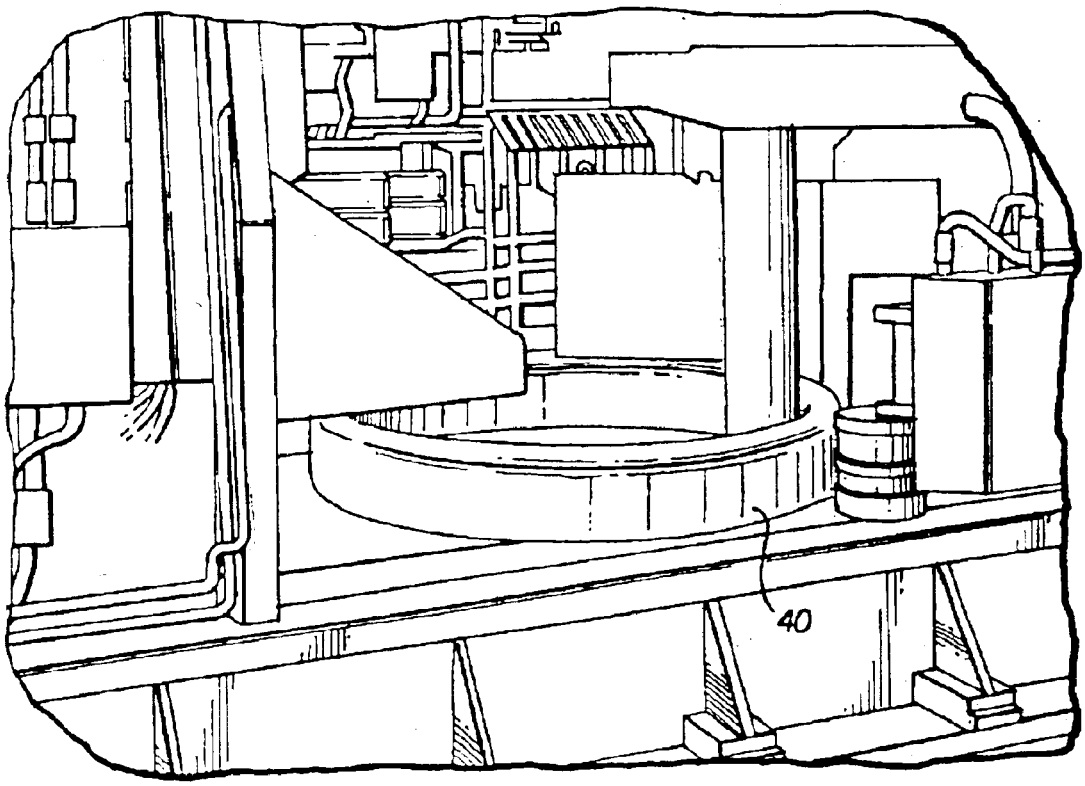
FIG. 4 is a depiction of a ring roll forming machine in operation.

Isotropic graphite is most preferred material as the main body of the mold of the present invention for the following reasons:

Isotropic graphite made via isostatic pressing or vibration molding has fine isotropic grains (3–40 microns) whereas extruded graphite produced via extrusion from relative coarse carbon particles result in coarse anisotropic grains (400–1200 microns).

Isotropic fine grained graphite has much higher strength, and structural integrity than other grades of graphite such as those made by extrusion process (extruded graphite) due to the presence of extremely fine grains, higher density and lower porosity, as well as the absence of "loosely bonded" carbon particles.

Isotropic graphite produced by isostatic pressing has fine grains (3–40 microns)

Isotropic graphite has much higher strength, structural integrity than extruded anisotropic graphite due to absence of "loosely bonded" carbon particles, finer grains, higher density and lower porosity.

Isotropic fine grained graphite can be machined with a very smooth surface compared to extruded graphite due to its high hardness, fine grains and low porosity. More particularly, this invention relates to the use of high density ultrafine grained isotropic graphite molds, the graphite of very high purity (containing negligible trace elements) being made via the isostatic pressing route. High density (>1.77 gm/cc), small porosity (<13%), high flexural strength (>7,000 psi), high compressive strength (>9,000 psi) and fine grains (<10 micron) are some of the characteristics of isostatically pressed graphite that render it suitable for use as molds for centrifugal casting superalloys. The other important properties of the graphite material are high thermal shock, wear and chemical resistance, and minimum wetting by liquid metal.

References relating to isotropic graphite include U.S. Pat. Nos. 4,226,900 to Carlson, et al, 5,525,276 to Okuyama et al, and 5,705,139 to Stiller, et al., all incorporated herein by reference.

Extruded anisotropic graphite is synthesized according to the following steps:

(1) Coarse grain coke (pulverized and purified) is mixed with pitch and warm extruded into green compacts.

(2) The green compacts are baked at 1200° C. (carbonization and densification). The binder (pitch is carbonized).

(3) The baked compact is graphitized into products that are highly porous and structurally weak. It is impregnated with pitch to fill the pores and improve the strength.

(4) The impregnated graphite is baked again at 1200 C to carbonize the pitch.

(5) The final product (extruded graphite) contains ~90–95% graphite and ~5–10% loosely bonded carbon.

The typical physical properties of isotropic made via isostatic pressing and anisotropic graphite made via extrusion graphite are given in Tables 1 and 2.

TABLE 1

(PROPERTIES OF ISOTROPIC GRAPHITE MADE VIA ISOSTATIC PRESSING)

| Grade | Density (gm/cc) | Shore Hardness | Flexural Strength (psi) | Compressive Strength (psi) | Grain Size (microns) | Thermal Conductivity BTU/ft-hr-° F. | Porosity (open) |
|---|---|---|---|---|---|---|---|
| R8500 | 1.77 | 65 | 7250 | 17,400 | 6 | 46 | 13% |
| R8650 | 1.84 | 75 | 9400 | 21750 | 5 | 52 | 12% |
| R8710 | 1.88 | 80 | 12300 | 34800 | 3 | 58 | 10% |

TABLE 2

(PROPERTIES OF ANISOTROPIC GRAPHITE MADE VIA EXTRUSION)

| Grade | Density (gm/cc) | Rockwell "R" Hardness | Flexural Strength (psi) | Compressive Strength (psi) | Grain Size (microns) | Thermal Conductivity BTU/ft-hr-° F. | Porosity (open) |
|---|---|---|---|---|---|---|---|
| HLM | 1.72 | 87 | 3500 | 7500 | 410 | 86 | 23% |
| HLR | 1.64 | 58 | 1750 | 4500 | 760 | 85 | 27% |

Isotropic fine grained graphite is synthetic material produced by the following steps:

(1) Fine grained coke extracted from mines is pulverized, separated from ashes and purified by flotation techniques. The crushed coke is mixed with binders (tar) and homogenized.

(2) The mixture is isostatically pressed into green compacts at room temperature.

(3) The green compacts are baked at 1200° C. causing carbonizing and densification. The binder is converted into carbon. The baking process binds the original carbon particles together (similar to the process of sintering of metal powders) into a solid mass.

(4) The densified carbon part is then graphitized at 2600° C. Graphitization is the formation of ordered graphite lattice from carbon. The carbon from the binder around the grain boundaries is also converted in graphite The final product is nearly 100% graphite (the carbon from the binder is all converted in graphite during graphitization).

Parameters referenced in the present specification are measured according to the following standards unless otherwise indicated.

Compressive strength is measured by ASTM C-695.

Flexural strength is measured by ASTM C 651.

Thermal conductivity is measured according to ASTM C-714

Porosity is measured according to ASTM C-830

Shear strength is measured according to ASTM C273, D732.

Shore hardness is measured according to ASTM D2240.

Grain size is measured according to ASTM E 112.

Coefficient of thermal expansion is measured according to E 83.1

Density is measured according to ASTM C838-96.

Oxidation threshold is measured according ASTM E 1269-90.

Vickers microhardness in HV units is measured according to ASTM E 384.

When liquid metal is poured into the extruded graphite molds, the mold wall/melt interface is subjected to shear and compressive stresses which cause fracture of graphite at the interface. The graphite particles and "loosely bonded carbon mass" plucked away from the mold wall are absorbed into the hot melt and begin to react with oxide particles in the melt and generate carbon dioxide gas bubbles. These gas bubbles coalesce and get trapped as porosity into the solidified castings.

Due to high intrinsic strength and absence of "loosely bonded" carbon mass, isotropic graphite will resist erosion and fracture due to shearing action of the liquid metal better than extruded graphite and hence castings made in isotropic graphite molds show less casting defects and porosity compared to the castings made in extruded graphite.

Additional information about isotropic graphite is disclosed in U.S. patent application Ser. No. 10/143,920, filed May 14, 2002, incorporated herein by reference in its entirety.

B. Alloys

The invention is advantageous for use with metallic alloys based on titanium. Such alloys generally contain at least about 50% Ti and at least one other element selected from the group consisting of Al, V, Cr, Mo, Nb, W, Sn, Si, Zr, Cu, C, B, and Fe, and inevitable impurity elements, wherein the impurity elements are less than 0.05% each and less than 0.15% total.

Suitable metallic alloys also include alloys based on titanium and aluminum known as titanium aluminides which typically contain 50–85% titanium, 15–36% Al, and at least one other element selected from the group consisting of Cr, Nb, V, Mo, Si and Zr and inevitable impurity elements, wherein the impurity elements are less than 0.05% each and less than 0.15% total.

C. The Mold

Typically a block of isotropic graphite is made as described above and then a mold cavity is machined into the block to form the isotropic graphite mold. If desired, the isotropic graphite can be initially pressed during formation to have a mold cavity.

Figure 5:
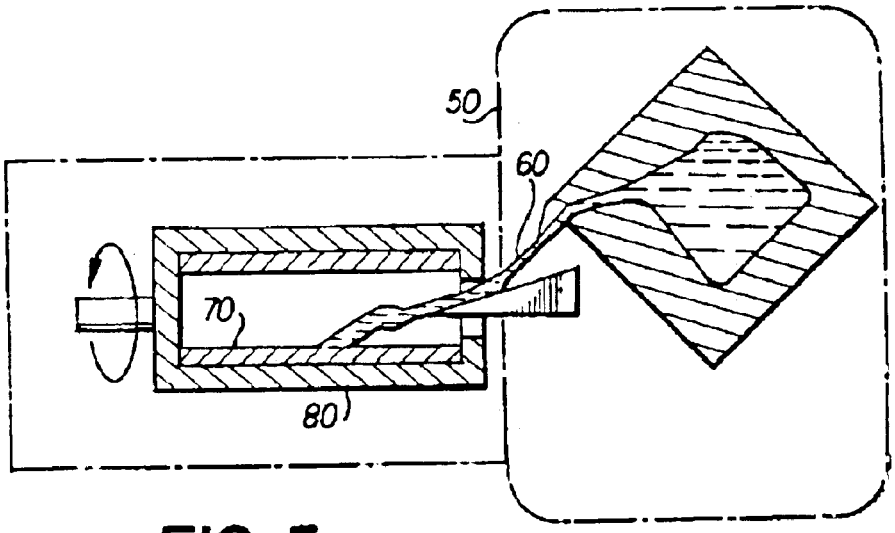
FIG. 5 shows a schematic drawing of the centrifugal vacuum casting equipment for casting titanium alloys in a rotating isotropic graphite mold under vacuum or partial pressure of inert gas to make hollow tube casting in accordance with the scope of the present invention.
Figure 6:
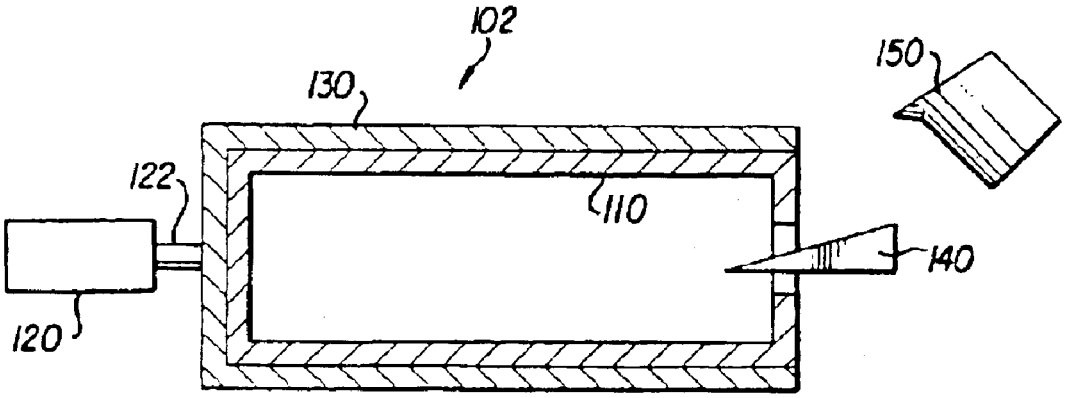
FIG. 6 is a schematic drawing of a cross-section of the centrifugal casting apparatus according to the present invention which further shows a motor for spinning the mold.

FIGS. 5 and 6 schematically show an embodiment of a rotatable centrifugal mold of the present invention for molding a hollow tube casting 70, 110, respectively.

FIG. 5 shows a schematic drawing of the centrifugal vacuum casting equipment for casting titanium alloys in a rotating isotropic graphite mold under vacuum or partial pressure of inert gas to make hollow tube casting in accordance with the scope of the present invention. With true centrifugal casting as depicted in FIG. 5, an isotropic graphite metal mold revolves under vacuum at high speeds in a horizontal, vertical or inclined position as the molten metal is being poured. The axis of rotation may be horizontal or inclined at any angle up to the vertical position. Molten metal is poured into the spinning mold cavity and the metal is held against the wall of the mold by centrifugal force. The speed of rotation and metal pouring rate vary with the alloy and size and shape being cast.

From a vessel in a vacuum chamber 50, molten metal 60 is poured through a launder into a rotating isotropic graphite mold 80. With centrifugal casting, the rotating isotropic graphite metal mold 80—revolves under vacuum at high speeds in a horizontal, vertical or inclined position as the molten metal 60 is being poured. The axis of rotation may be horizontal or inclined at any angle up to the vertical position. Molten metal 60, poured into the spinning mold cavity, is held against the wall of the mold 80 by centrifugal force. The speed of rotation and metal pouring rate vary with the alloy and size and shape being cast.

As the molten metal alloy 60 is poured into the rotating isotropic graphite mold 80, it is accelerated to mold speed. Centrifugal force causes the metal to spread over and cover the mold surface. Continued pouring of the molten metal 60 increases the thickness to the intended cast dimensions. Rotational speeds vary but sometimes reach more than 150 times the force of gravity on the outside surface of the castings.

Once the metal 60 is distributed over the mold surface, solidification begins immediately. Metal feeds the solid-liquid interface as it progresses toward the bore. This, combined with the centrifugal pressure being applied, results in a sound, dense structure across the wall with impurities generally being confined near the inside surface. The inside layer of the solidified part can be removed by boring if an internal machined surface is required. Accordingly, the hollow tube casting 70 is solidified and recovered.

FIG. 6 is a schematic drawing of a cross-section of the centrifugal casting apparatus according to the present invention which further shows a motor for spinning the mold.

FIG. 6 shows a mold 102 including a hollow isotropic graphite cylinder 110 within a holder 30. The holder 130 is attached to a shaft 122 of a motor 120. Molten metal (shown in FIG. 5, but not shown in FIG. 6) would be discharged from a vessel 150 through a launder 140 into the cavity of the isotropic graphite cylinder 110. The cylinder is attached to the base 130 attached to the shaft 122. The motor 120 turns the shaft to turn the cylinder 110 at a speed sufficient for centrifugal casting. In other words, sufficient to drive the melt to a consistent thickness along the inner longitudinal walls of the cylinder 110 while the melt cools and solidifies. The mold is conveniently made of two parts. During spinning the two parts are held together by the holder 130 and/or other appropriate means, e.g., bracing not shown. After the melt solidifies, the cylinder 110 is opened and the metal tube product is removed.

Figure 7:
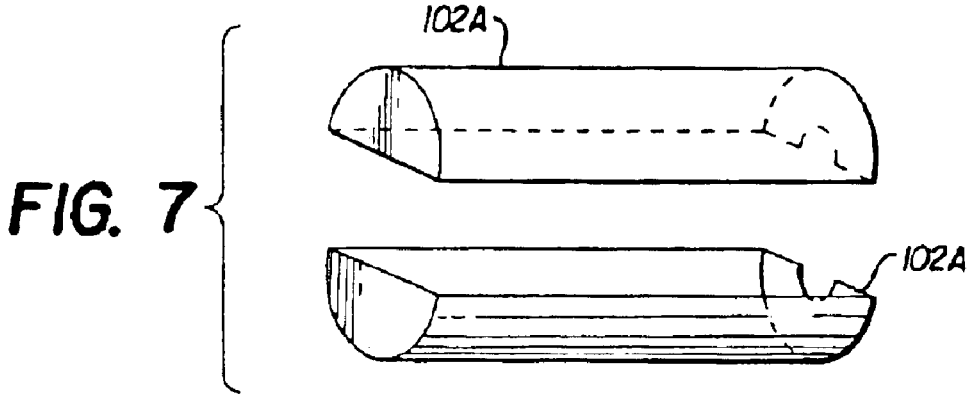
FIG. 7 shows the mold as two longitudinally split pieces.
Figure 8:
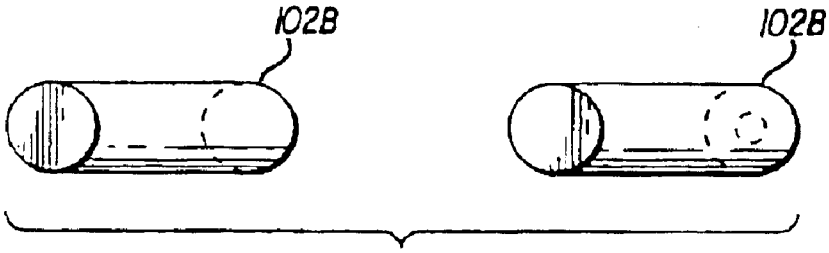
FIG. 8 shows the mold as two transversely split pieces.

For example, the mold 110 may be made of two longitudinally split parts as shown in FIG. 7 or may be made of two transversely split parts as shown in FIG. 8. Thus, the graphite cylinder 110 is reusable.

Figure 9:
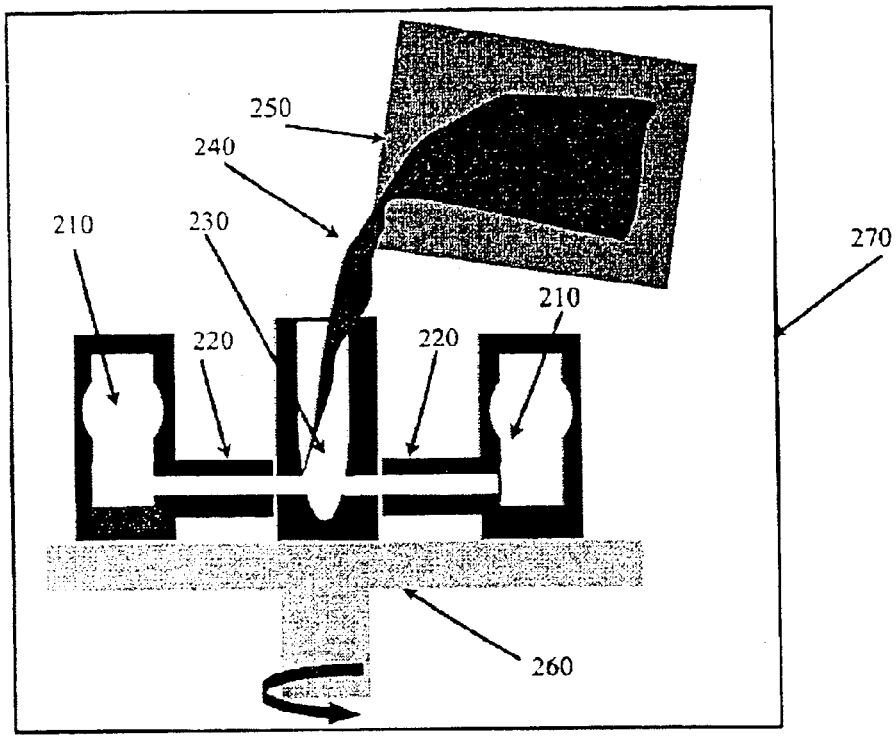
FIG. 9 illustrates the centrifuge casting of titanium in isotropic graphite molds.

FIG. 9 shows an embodiment of equipment for centrifuge casting of titanium alloys in isotropic graphite molds. The molds 210 have two halves with a parting line. Each half of the mold is machined into a cavity of desired geometry. The fully assembled molds are equally spaced placed along the circumference of horizontal turn table 260 at equidistance from the center. A downsprue 230 with a machined cavity is located at the center of the turn table. The cavity of the downsprue is connected to each mold cavity by horizontal runner 220. The entire mold/runner/downsprue assembly is made of isotropic graphite. The metal is melted in the furnace 250 inside a vacuum chamber 270 under vacuum and/or inert gas atmosphere and the molten metal 240 is poured into the downsprue of the mold assembly rotating at high speeds. The speed of rotation varies depending on the size of the casting and the type of metal.

The action of centrifugal force leads to rapid feeding of melt from the downsprue into the mold cavities via the runner resulting into improved mold filling and production of high quality precision castings. The centrifugal force imposed on the melt enhances removal of gas bubbles and reduces the number of gaseous defects. This centrifuge effect promotes the filling of thin section of mold cavities with attendant fine detail and form. Centrifugal force allows the melt to flow into even the most obscure crevices of the mold cavities. Centrifugation is maintained until the melt solidifies. Molten metal shrinks as it cools. After the melt solidifies, the split halves of the molds are made to open and the castings are removed without breakage of the molds. The isotropic graphite molds do not react with molten titanium and hence the molds can be reassembled for repeated uses.

Figure 10:
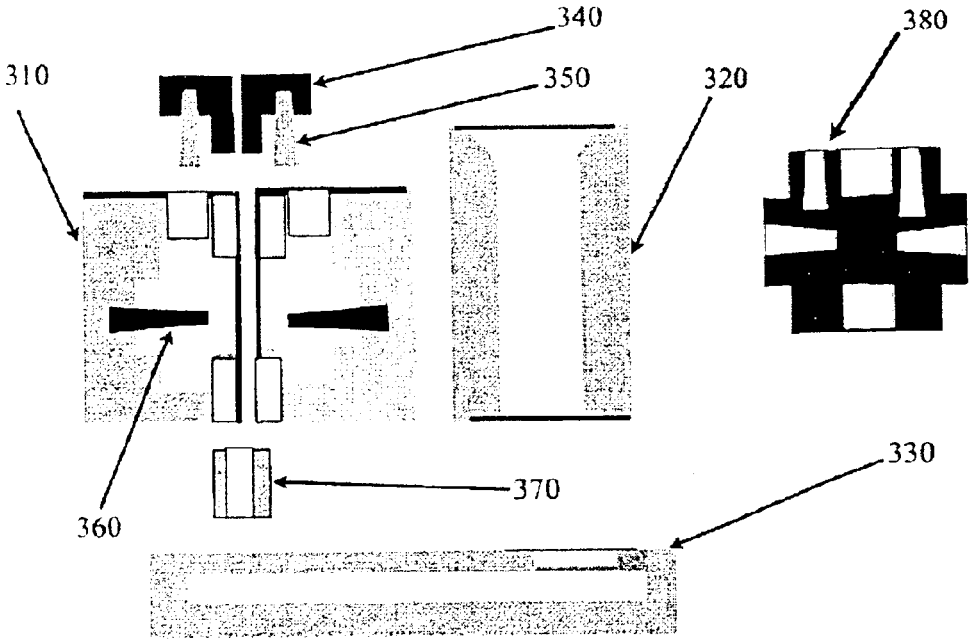
FIG. 10 shows the various modular mold components with stationary and removable cores needed to fabricate a titanium casting in accordance with the scope of the present invention.

To create "undercuts" and "holes" in the castings, isotropic graphite cores machined with precision tolerances are assembled into the main mold cavities. The cores can be stationary or movable depending on the geometry of the castings. The stationary core can not be removed from the castings once melt solidifies around it and hence it is to be sacrificed after one time use. To be able to incorporate cores of various geometries in the mold cavities, the molds are made of several modular components and then assembled to create the desired cavity. FIG. 10 shows the various modular mold components with stationary and removable cores needed to fabricate a titanium casting 380 in accordance with the scope of the present invention. The main mold 310 with two split halves has a machined cavity. The removable cores 360 and 340 are inserted into the specific locations of the cavities. The cores 370 and 350 are stationary or sacrificial cores also made of isotropic graphite. Such cores can not be removed from the casting and hence, these cores are destroyed after each pour of the casing.

Figure 11:
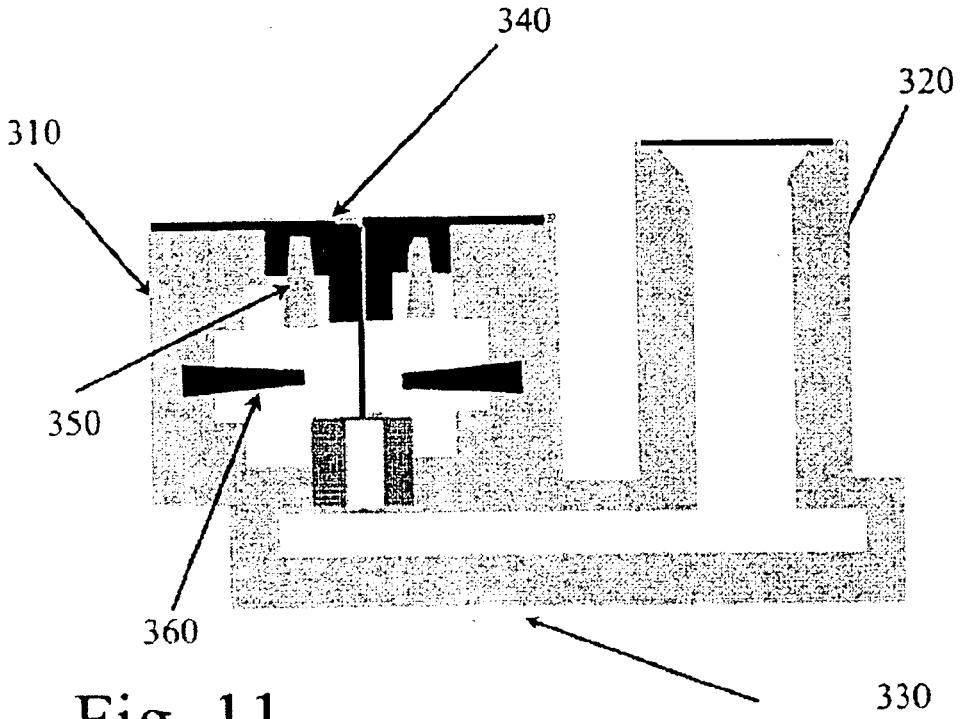
FIG. 11 shows the modular mold fully assembled with movable cores, stationary cores, downsprue and runner.

FIG. 11 shows the modular mold fully assembled with movable cores 340 and 360, stationary cores 350 and 370, downsprue 380 and runner 330.

Figure 12:
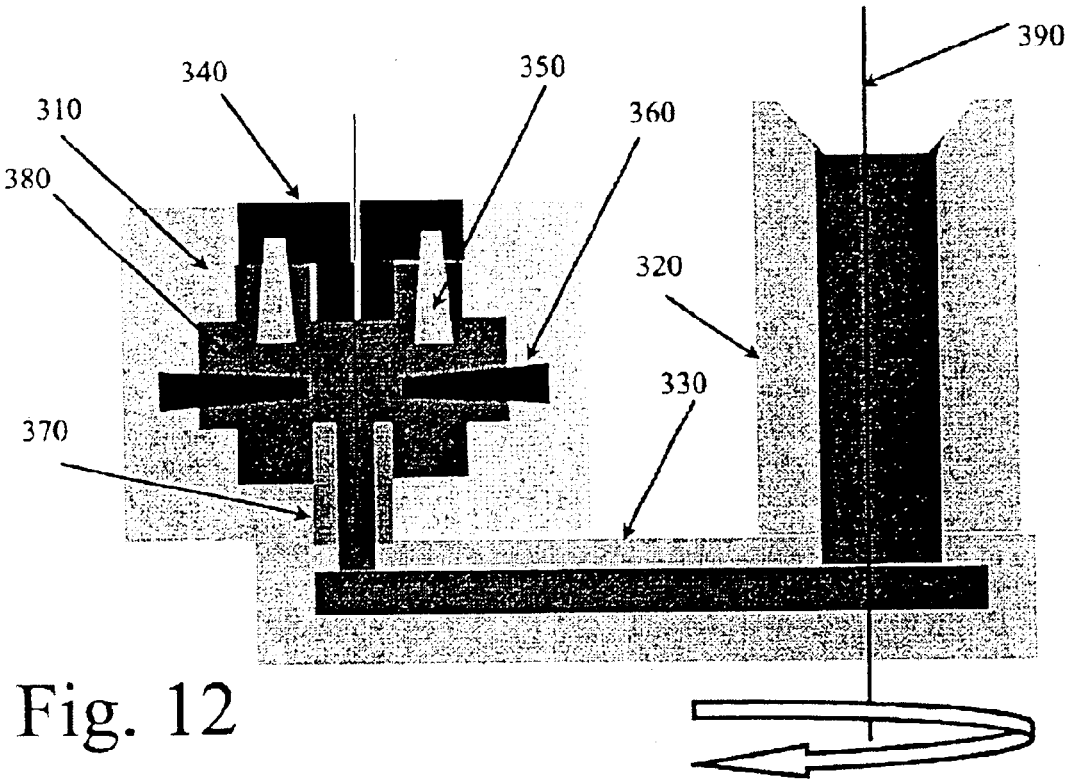
FIG. 12 shows centrifuge casting of titanium melt in the cavity of the modular mold assembly which is being spun around the vertical axis of the downsprue.
Figure 13:
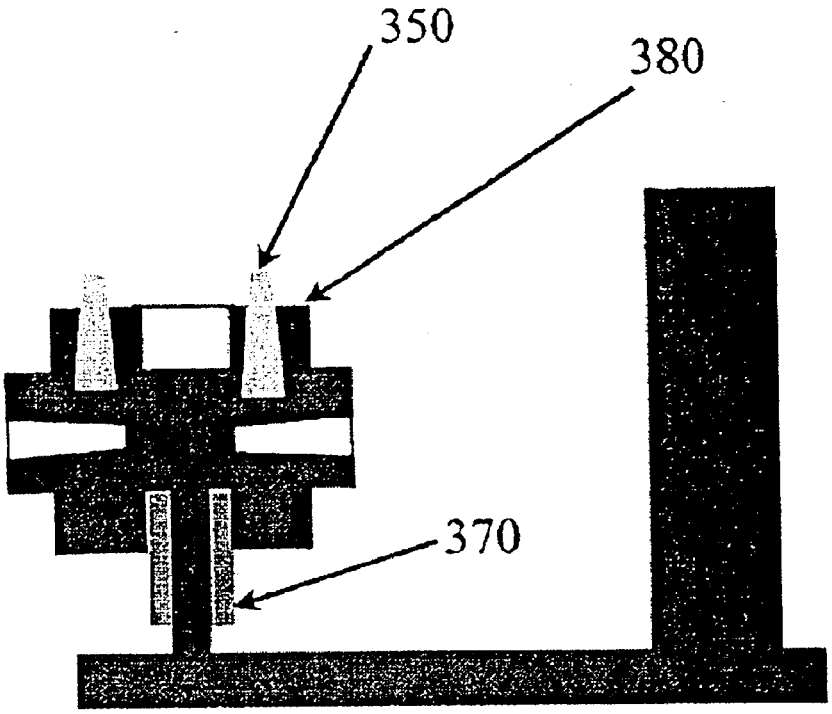
FIG. 13 shows the modular mold disassembled to remove the casting after the melt solidifies.
Figure 14:
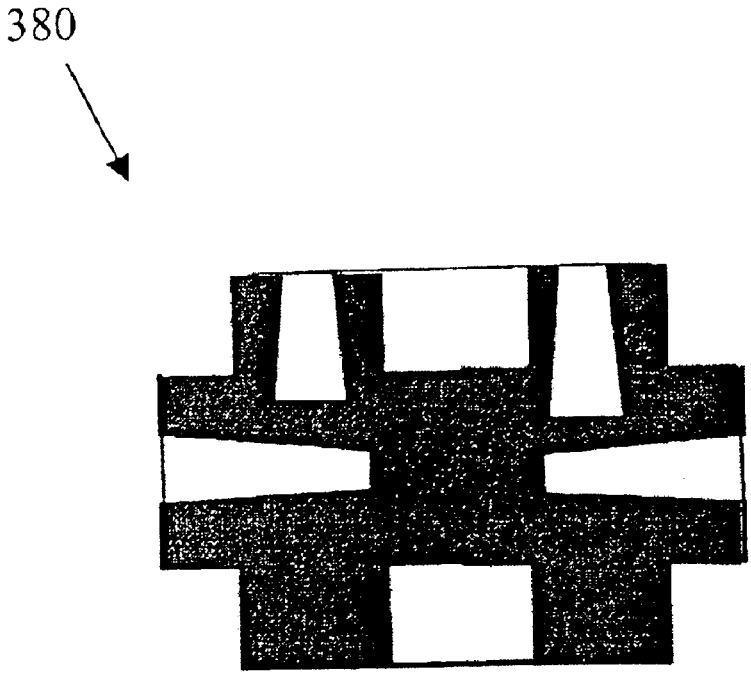
FIG. 14 shows the final casting.

FIG. 12 shows centrifuge casting of titanium melt in the cavity of the modular mold assembly which is being spun around the vertical axis 390 of the downsprue. The melt poured into the downsprue travels fast through the runner into the mold cavity. After the melt solidifies, the modular mold is disassembled to remove the casting 380 as shown in FIG. 13. The stationary cores 350 and 370 are crushed and removed from the casting 380. The sprue and runner sections are subsequently cut off and/or machined to generate the final casting as shown in FIG. 14.

In another embodiment of the present invention, a technique to quickly disassemble the modular mold under vacuum is incorporated in the centrifuge casting apparatus. As the melt in the mold begins to solidify, it shrinks on to the graphite cores. As a consequence the castings are subjected to tensile stresses that may lead to cracks in the castings and as well as on the removable graphite cores. To prevent this problem, a mechanism is provided into the apparatus to open the split halves of the modular mold assembly along the parting line while still under vacuum within a very short time after the completion of pouring of the melt and when the melt has completely solidified to 100–200° C. below the solidus temperatures of the alloys and when the casting has not yet underwent any measurable shrinkage. A manipulator which is introduced from outside into the vacuum via a vacuum feedthrough is used to open the mold assembly along the parting line and then eject the casting from the mold cavity while still hot.

Figure 15:
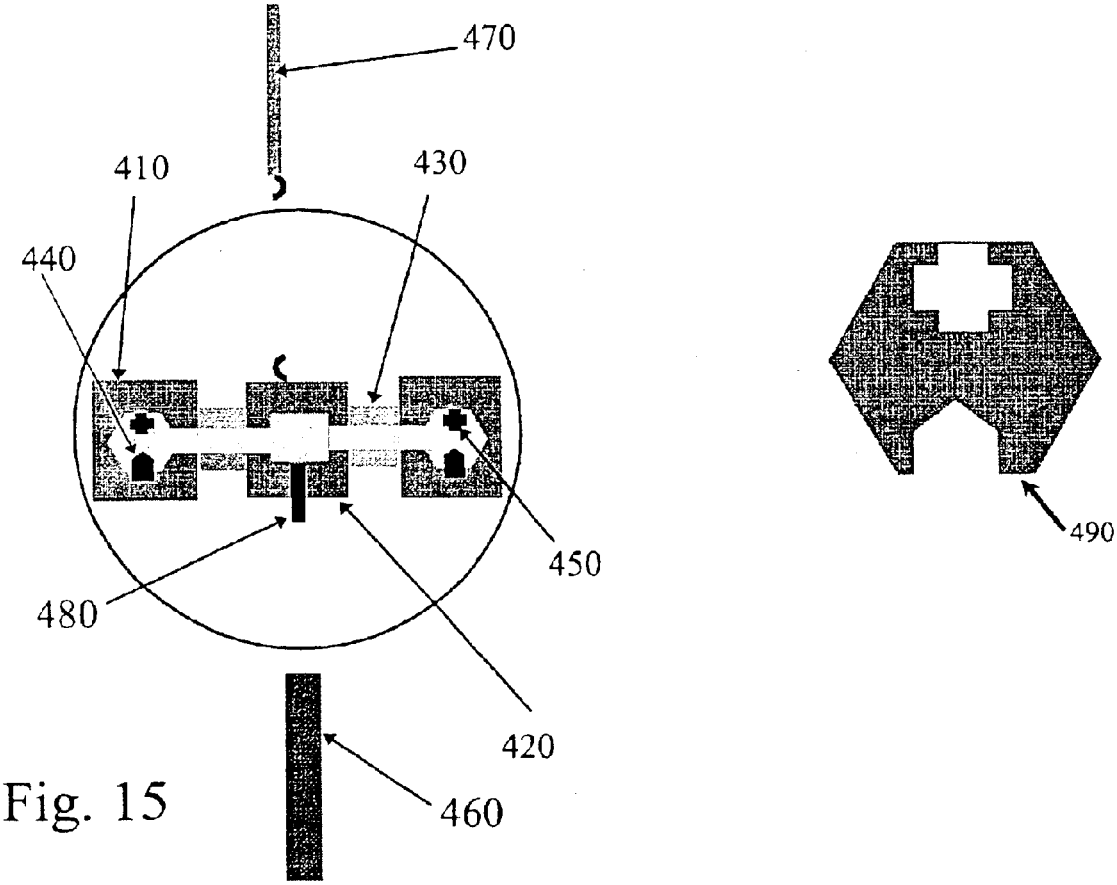
FIG. 15 shows the various modular mold components with stationary and removable cores and location of manipulator and plunger needed to fabricate a titanium casting in accordance with the scope of the present invention.
Figure 16:
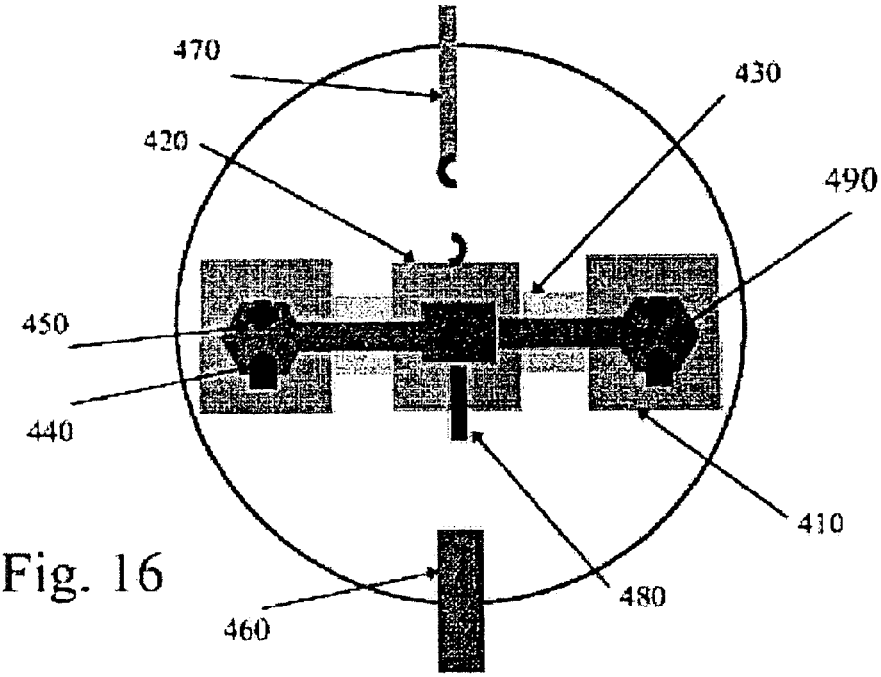
FIG. 16 shows the modular mold fully assembled with movable cores, stationary cores, downsprue and runner. The mold is rapidly filled with molten titanium while it is spinning around a vertical axis of the downsprue.
Figure 17:
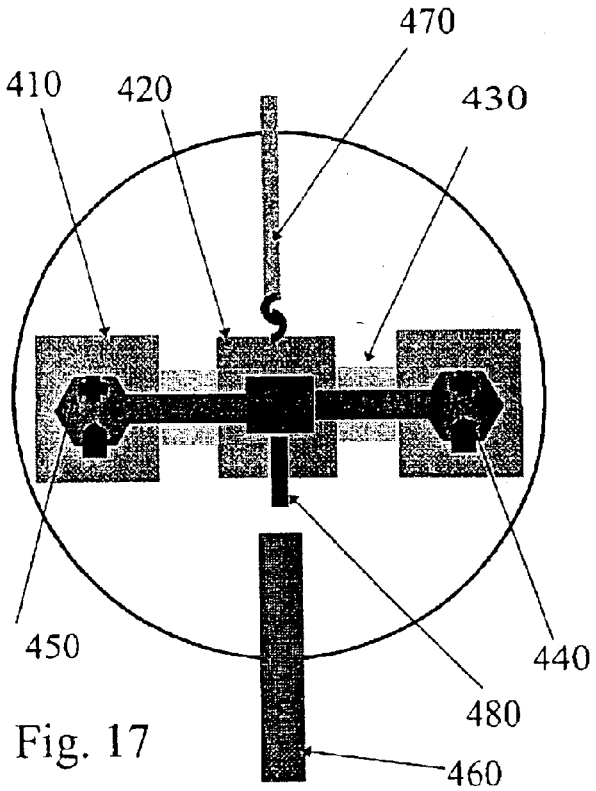
FIG. 17 shows the manipulator introduced from outside the vacuum chamber and connected to one half of the mold assembly.
Figure 18:
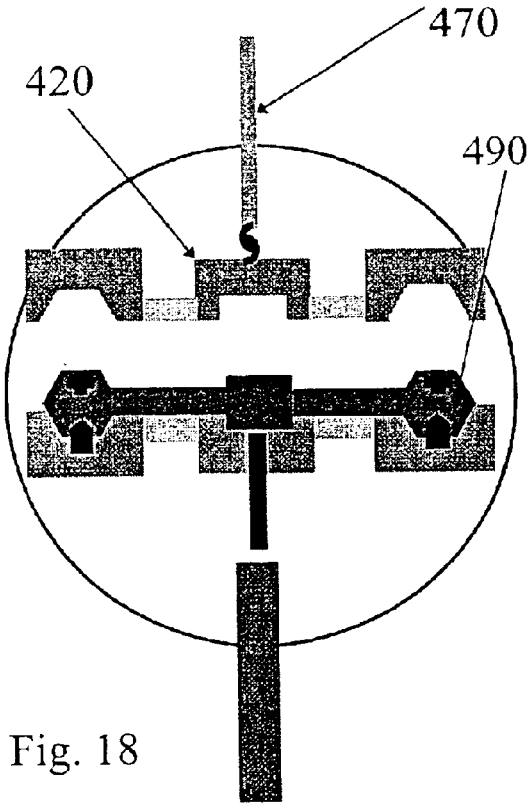
FIG. 18 shows the release of one half of the mold assembly by the manipulator.
Figure 19:
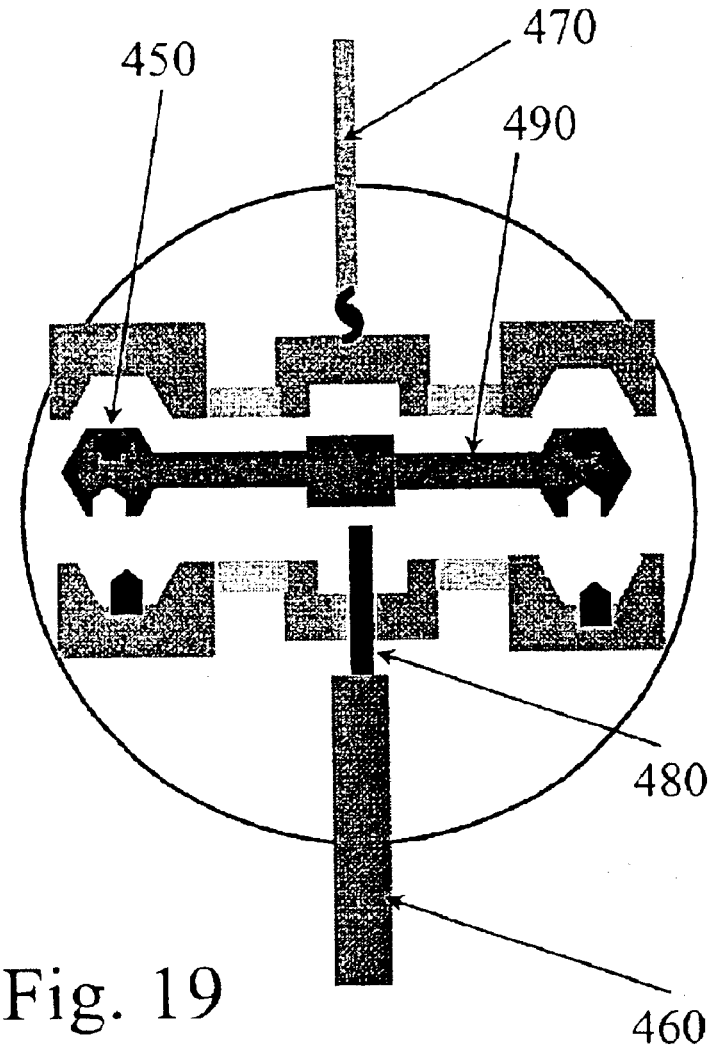
FIG. 19 shows the ejection of the casting from the mold by the action of a plunger.

FIG. 15 shows the various modular mold components with stationary and removable cores needed to fabricate a titanium casting 490 in accordance with the scope of the present invention. The main mold 410 with two split halves has a machined cavity. The removable cores 440 are inserted into the specific locations of the cavities. The cores 450 are stationary or sacrificial cores also made of isotropic graphite. Such cores can not be removed from the casting and hence, these cores are destroyed after each pour of the casing. FIG. 16 shows the modular mold fully assembled with movable cores 440, stationary cores 450, downsprue 420 and runner 430. The mold is rapidly filled with molten titanium 490 while it is spinning around a vertical axis of the downsprue. After the pouring is completed and when the temperature of the casting has reached a temperature of about 100 -200° C. below the liquidus temperature of the alloy, the manipulator 470 is introduced from the outside the vacuum chamber via a vacuum feedthrough to connect to a clamp attached to of one half of the mold assembly as shown in FIG. 17. The manipulator activates a mechanism to release the clamp holding the mold halves together and then pulls one half away from the other half of the mold (FIG. 18). Immediately, a plunger 460 is activated at the opposite end of the vacuum chamber to push the ejector pin 480 which ejects the hot casting 490 out of the other half of the split mold (FIG. 19).

Figure 20:
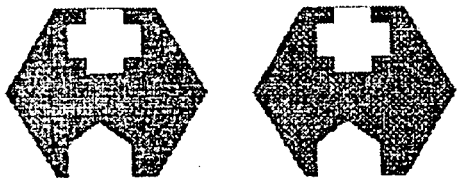
FIG. 20 shows the final casting.

After the casting reaches ambient temperature, it is removed from the vacuum chamber. The sprue and runner sections are subsequently cut off and/or machined to generate the final casting as shown in FIG. 20.

Another embodiment of the present invention is the use of thin walled sacrificial cores made of isotropic graphite. The stationary or sacrificial cores 350 and 370 as in FIGS. 10 and 450 in FIG. 15 are solid made of isotropic graphite. Also shown in FIG. 21, several stationary/sacrificial cores which are assembled in the main mold cavities to create complex cavities or holes or hollow spaces in the castings. These are solid cores. They remain embedded in the castings even after the castings are removed from the main molds. The casting on solidification shrinks around the stationary solid cores which do not yield and hence high residual stresses are developed in the solidified castings which may lead to fracture and cracks in the castings.

Figure 21:
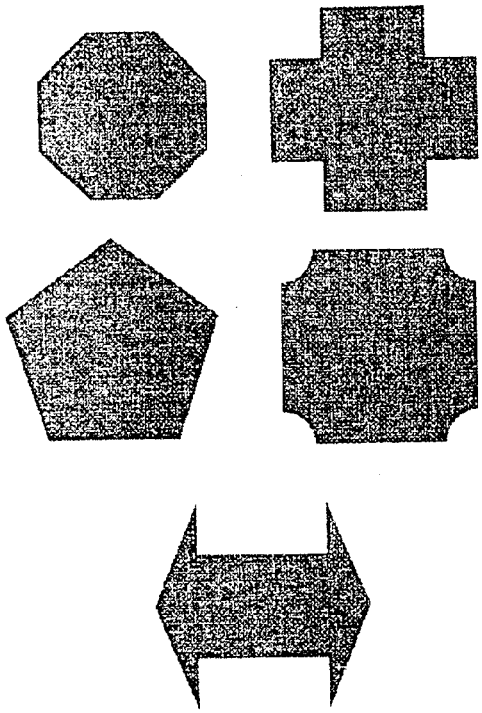
FIG. 21 shows the design of several solid cores made of isotropic graphite.
Figure 22:
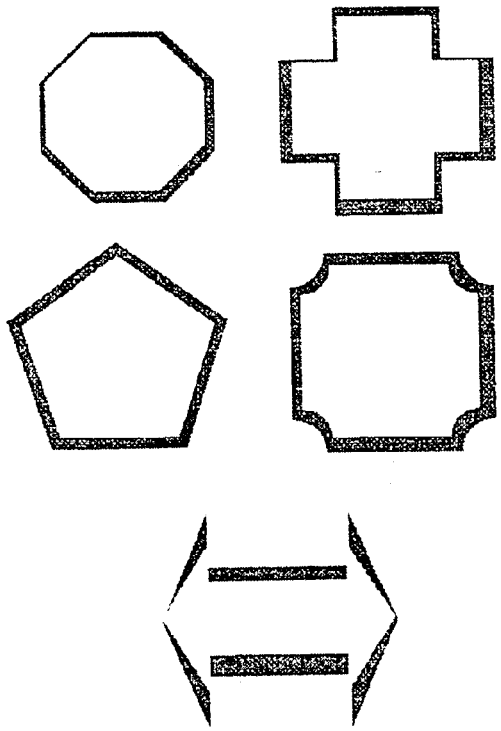
FIG. 22 shows the design of several thin walled hollow cores made of isotropic graphite.

In accordance with the scope of the present invention, the above problem is avoided by the use of stationary graphite core made of hollow and thin walled structure. For example, the solid cores as shown in FIG. 21 can be machined into thin walled hollow cores as shown in FIG. 22. During solidification as the casting shrinks around the stationary hollow cores, the compressive stresses generated due to shrinkage crush the cores and the residual stresses are relieved to prevent crack formation in the casting.

D. Use of the Mold

Centrifugal castings are produced by pouring the molten metal under vacuum or under a low pressure of inert gas in molds machined from fine grained high density, high strength isotropic graphite, the said molds either revolving around its own horizontal or vertical axis or centrifuging around a vertical axis of rotation. An alloy is melted by any conventional process that achieves uniform melting and does not oxidize or otherwise harm the alloy. For example, a preferred heating method is vacuum induction melting. Vacuum induction melting is a known alloy melting process as described in the following references:

D. P. Moon et al, ASTM Data Series DS 7-SI, 1–350 (1953)

M. C. Hebeisen et al, NASA SP-5095, 3142 (1971)

R. Schlatter, "Vacuum Induction Melting Technology of High Temperature Alloys", Proceedings of the AIME Electric Furnace Conference, Toronto, 1971.

Examples of other suitable heating processes include "plasma vacuum arc remelting" technique and induction skull melting.

The candidate titanium and titanium base alloys are melted in vacuum by an induction melting technique and the liquid metal is poured under full or partial vacuum into the heated or unheated graphite mold. In some instances of partial vacuum, the liquid metal is poured under a partial pressure of inert gas. The molding then occurs under full or partial vacuum. During casting (molding) the mold is subjected to centrifuging. As a consequence of the centrifuging action, molten alloy poured into the mold will be forced from the central axis of the equipment into individual mold cavities that are placed on the circumference. This provides a means of increasing the filling pressure within each mold and allows for production of intricate details.

The tubular products of titanium alloys may be produced based on vacuum centrifugal casting of the selected alloys in a molten state in an isotropic graphite mold, wherein the mold is rotated about its own axis. The axis of rotation may be horizontal or inclined at any angle up to the vertical position. Molten metal is poured into the spinning mold cavity and the metal is held against the wall of the mold by centrifugal force. The speed of rotation and metal pouring rate vary with the alloy and size and shape being cast. During molding the mold typically rotates at 10 to 3000 revolutions per minute. Rotation speed may be used to control the cooling rate of the metal.

The inside surface of a true centrifugal casting is cylindrical. In semi-centrifugal casting, a central core is used to allow for shapes other than a true cylinder to be produced on the inside surface of the casting. Centrifugal casting of the present invention encompasses true centrifugal casting, semi-centrifugal casting and centrifuge casting.

The uniformity and density of centrifugal castings are expected to approach that of wrought material, with the added advantage that the mechanical properties are nearly equal in all directions. Directional solidification from the outside surface contacting the mold will result in castings of exceptional quality free from casting defects.

High purity and high density of the isotropic graphite mold material of the present invention enhances non-reactivity of the mold surface with respect to the liquid melt during solidification. As a consequence, the process of the present invention produces a casting having a very smooth high quality surface as compared to the conventional ceramic mold casting process. The isotropic graphite molds show very little reaction with molten titanium and titanium base alloys and suffer minimal wear and erosion after use and hence, can be used repeatedly over many times to fabricate centrifugal castings of the said alloys with high quality. In contrast, the conventional ceramic molds are used one time for fabrication of titanium castings. The present invention is particularly suitable for fabricating highly alloyed titanium alloys and titanium aluminide alloys which are difficult to fabricate by other processes such as forging or machining. Such alloys can be fabricated in accordance with the present invention as near net shaped or net shaped components thereby minimizing subsequent machining operations.

Furthermore, the fine grain structures of the castings resulting from the fast cooling rates experienced by the melt will lead to improved mechanical properties such as high strength for many titanium base alloys suitable for applications as jet engine and air frame structural components.

According to the present invention, titanium alloys and titanium alloys are induction melted in a water cooled copper crucible and are centrifugally cast in high density, high strength ultrafine grained isotropic graphite molds with machined cavities heated in-situ at temperatures between 150° C. and 800° C. Furthermore, titanium alloys can be melted in water-cooled copper crucible via the "plasma vacuum arc remelting" technique. The castings are produced with high quality surface and dimensional tolerances free from casting defects and contamination. Use of the centrifugal casting process according to the present invention eliminates the necessity of chemical milling to clean the contaminated surface layer on the casting as commonly present in titanium castings produced by the conventional investment casting method. Since the isotropic graphite molds do not react with the titanium melt and show no sign of erosion and damage, the molds can be used repeatedly numerous times to lower the cost of production.

Another embodiment of the present invention involving the centrifugal casting of titanium base alloys relates to the use of high density high strength isotropic graphite molds with the mold cavity having been coated with hafnium carbide or tantalum carbide or tungsten or rhenium, wherein the coating is produced with thickness between 2 to 100 microns on the cavity of graphite mold by one of the processes such as the chemical vapor deposition (CVD), sputtering, magnetron-sputtering or plasma assisted chemical vapor deposition techniques. Hafnium carbide, tungsten or rhenium coatings produced by one of the above mentioned processes have very high purity containing negligible trace elements.

The present invention also relates to use of centrifugal casting of titanium alloy and the use of hafnium carbide, tantalum carbide, tungsten or rhenium as a thin coating on bulk isotropic graphite that acts as the main body of the mold. In particular, the invention relates to a method of making cast shapes of a metallic alloy, comprising the steps of: melting the alloy to form a melt under vacuum or partial pressure of inert gas; pouring the melt of the alloy into the cavity of a composite mold which is made essentially of isotropic graphite having a machined mold cavity, wherein the surface of the mold cavity is coated with a thin coating of hafnium carbide, tantalum carbide, tungsten or rhenium, wherein the said composite molds either revolving around its own horizontal or vertical axis or centrifuging around a vertical axis of rotation.

The present invention may be used to make castings for a wide variety of titanium alloy products. Typical products include titanium alloy products for the aerospace, chemical and energy industries, medical prosthesis, and/or golf club heads. Typical medical prosthesis include surgical implants, for example, plates, pins and artificial joints (for example hip implants or jaw implants). The present invention may also be used to make golf club heads.

EXAMPLE 1

Tables 3 and 4 list several titanium and titanium aluminide alloys processed into of high quality by centrifugal casting in isotropic graphite molds in accordance with the invention.

TABLE 3

(Titanium alloys)

| Alloy | Composition (wt %) | | | | | | | | | |
|---|---|---|---|---|---|---|---|---|---|---|
| No. | Ti | Al | V | Sn | Fe | Cu | C | Zr | Mo | Other |
| 1 | Bal | 6.0 | 5.05 | 2.15 | 0.60 | 0.55 | 0.03 | | | |
| 2 | Bal | 3.0 | 10.3 | 2.1 | | | 0.05 | | | |
| 3 | Bal | 5.5 | | 2.1 | | | | 3.7 | 0.3 | |
| 4 | Bal | 6.2 | | 2.0 | | | | 4.0 | 6.0 | |
| 5 | Bal | 6.2 | | 2.0 | | | | 2.0 | 2.0 | 2.0 Cr 0.25 Si |
| 6 | Bal | 5.0 | | 2.25 | | | | | | |
| 7 | Bal | 2.5 | 13 | 7.0 | | | | 2.0 | | |
| 8 | Bal | 3.0 | 10 | | 2 | | | | | |
| 9 | Bal | 3 | 15 | 3 | | | | | | 3.0 Cr |
| 10 | Bal | | | 4.5 | | | | 6 | 11.5 | |

TABLE 4

(Titanium aluminum alloys)

| Alloy | Composition (wt %) | | | | |
|---|---|---|---|---|---|
| No. | Ti | Al | Nb | V | Other |
| 1 | Bal | 14 | 21 | | |
| 2 | Bal | 18 | 3 | 2.7 | |
| 3 | Bal | 31 | 7 | 1.8 | 2.0 Mo |
| 4 | Bal | 24 | 15 | | |
| 5 | Bal | 26 | 12 | | |
| 6 | Bal | 25 | 10 | 3.0 | 1.5 Mo |

Typical shapes of titanium castings that can be fabricated by the method of centrifugal casting in isotropic graphite molds rotated around its own axis described in the present invention are as follows:

Rings and hollow tubes and the like with typical dimensions as follows: 4 to 80 inch diameter×0.25 to 4 inch wall thickness×1 to 120 inches long The molds can be machined to produce contoured profiles on the outside diameter of the centrifugally cast tubular products and rings of titanium alloys.

The molds can be machined with a taper so that the castings with desired taper can be directly cast according to specific designs.

EXAMPLE 2

Using the centrifuge casting method in accordance with the scope of the present invention, titanium alloys listed in Tables 3 and 4 are fabricated as castings of intricate shapes and thin walls. This technique is capable of producing castings with thin walls ranging between 0.05 to 0.1 inch in thickness. The modular molds with machined cavity assembled with stationary and removable cores as per FIG. 11 are positioned along the perimeter of a turn table and are rotated at speeds between 100–1000 RPM. The molten metal of a titanium alloy is introduced into the downsprue and is forced towards the mold cavities via the runners under the action of the centrifugal force mold cavities through the runners. The castings are produced with high surface quality free from alpha casing and casting defects.

EXAMPLE 3

Using the centrifuge casting method in accordance with the scope of the present invention, titanium alloys listed in Tables 3 and 4 are fabricated as castings of intricate shapes and thin walls. The modular molds with machined cavity assembled with stationary and removable cores as per FIG. 15 are positioned along the perimeter of a turn table and are rotated at speeds between 100–1000 RPM. The molten metal of a titanium alloy is introduced into the downsprue and is forced towards the mold cavities via the runners under the action of the centrifugal force mold cavities through the runners.

Using a mechanism provided into the apparatus, the split halves of the modular mold assembly are made to open along the parting line while still under vacuum within a very short time after the completion of pouring of the melt and when the melt has completely solidified to 100–200C below the solidus temperatures of the alloys and when the casting has not yet underwent any measurable shrinkage. A manipulator which is introduced from outside into the vacuum via a vacuum feedthrough is used to open the mold assembly along the parting line and then eject the casting from the mold cavity while still hot. After the casting reaches ambient temperature, it is removed from the vacuum chamber. The sprue and runner sections are subsequently cut off and/or machined to generate the final castings.

EXAMPLE 4

Using the centrifuge casting method in accordance with the scope of the present invention, titanium alloys listed in Tables 3 and 4 are fabricated as castings of intricate shapes and thin walls. The modular molds with machined cavity are assembled with stationary thin and hollow cores as shown in FIG. 22. The cores are embedded into the main mold cavities. The molds are positioned along the perimeter of a turn table and are rotated at speeds between 100–1000 RPM. The molten metal of a titanium alloy is introduced into the downsprue and is forced towards the mold cavities via the runners under the action of the centrifugal force mold cavities through the runners. During solidification as the casting shrinks around the stationary hollow cores, the compressive stresses generated due to shrinkage crush the cores and the residual stresses are relieved to prevent crack formation in the casting. After the casting reaches ambient temperature, it is removed from the vacuum chamber. The sprue and runner sections are subsequently cut off and/or machined to generate the final castings with good quality.

EXAMPLE 5

The machined cavities of the isotropic graphite molds in examples 1 and 2 are coated with a thin coating of either hafnium carbide or tantalum carbide or tungsten or rhenium. Alloys listed in Tables 3 and 4 are produced in accordance with the scope of the present invention as high quality castings free from alpha casing and surface defects.

It should be apparent that in addition to the above-described embodiments, other embodiments other embodiments are also encompassed by the spirit and scope of the present invention. Thus, the present invention is not limited by the above-provided description, but rather is defined by the claims appended hereto.

What is claimed is:

1. A centrifugal casting apparatus for casting metal products comprising, a central sprue for rotating along a vertical axis of the central sprue, isotropic graphite molds which have cavities, horizontal runners for passing a melt there through under the action of centrifugal force radially outward into the cavities of the molds spinning along a circumference of a circle of rotation, and means for rotating the isotropic graphite molds.

2. The apparatus of claim 1, wherein the isotropic graphite mold comprises machined graphite, wherein the graphite has been isostatically or vibrationally molded and has ultra fine isotropic grains between 3–40 micron, a density between 1.65 and 1.9 grams/cc, flexural strength between 5,500 and 20,000 psi, compressive strength between 12,000 and 35,000 psi, and porosity below 15%.

3. The apparatus according to claim 2, wherein the isotropic graphite mold comprises at least two isotropic graphite portions which are releasably attached to each other such that a metal product cooled within the mold can be removed from the mold.

4. The apparatus according to claim 1, wherein the isotropic graphite mold comprises at least two isotropic graphite portions which are releasably attached to each other such that a metal product cooled within the mold can be removed from the mold.

5. The apparatus according to claim 2, wherein a coating of either hafnium carbide or tungsten or rhenium is deposited on the surface of each cavity.

6. A centrifugal casting apparatus for casting metal products comprising, a central sprue for rotating along a vertical axis of the central sprue, isotropic graphite molds which have cavities, horizontal runners for passing a melt there through under the action of centrifugal force radially outward into the cavities of the molds spinning along a circumference of a circle of rotation, and means for rotating the isotropic graphite molds and means for disassembling the mold under vacuum and ejecting the casting from the mold cavity when the casting has solidified to a temperature which is below the solidus temperature of the alloy and yet lies within less than 200 C below solidus temperature.

7. A centrifugal casting apparatus for casting metal products comprising, an isotropic graphite mold having a cavity, and means for rotating the isotropic graphite mold, wherein a coating of either hafnium carbide or tungsten or rhenium is deposited on the surface of the cavity.

* * * * *